US005359937A

United States Patent [19]

Dittrich

[11] Patent Number: 5,359,937

[45] Date of Patent: Nov. 1, 1994

[54] REDUCED ENERGY CARTRIDGE

[75] Inventor: William A. Dittrich, Denville, N.J.

[73] Assignee: SNC Industrial Technologies Inc./Les Technologies Industrielles SNC Inc., Quebec, Canada

[21] Appl. No.: 773,591

[22] PCT Filed: Mar. 22, 1991

[86] PCT No.: PCT/CA91/00090

§ 371 Date: Jan. 21, 1992

§ 102(e) Date: Jan. 21, 1992

[87] PCT Pub. No.: WO91/14916

PCT Pub. Date: Oct. 3, 1991

Related U.S. Application Data

[63] Continuation-in-part of Ser. No. 497,027, Mar. 22, 1990, abandoned.

[51] Int. Cl.[5] ..... F42B 5/02

[52] U.S. Cl. ..... 102/430; 102/444; 102/464; 102/530

[58] Field of Search ..... 102/430, 434, 439, 444, 102/445, 446, 447, 464, 520, 521, 522, 523, 530, 531, 532; 89/14.5

[56] References Cited

U.S. PATENT DOCUMENTS

| | | | |
|---|---|---|---|
| 225,464 | 3/1880 | Coloney | 102/523 |
| 2,389,846 | 11/1945 | Ericson | 102/523 |
| 2,654,318 | 10/1953 | Dunham | 102/430 |
| 2,812,713 | 11/1957 | Fitzsimmons | 102/446 |
| 2,866,412 | 12/1958 | Meyer et al. | 102/434 |
| 2,898,694 | 8/1959 | Senutovitch | 102/447 |
| 3,865,038 | 2/1975 | Barr | 102/502 |
| 4,686,905 | 8/1987 | Sgabo | 102/444 |
| 4,899,660 | 2/1990 | Brighton | 102/447 |
| 5,016,536 | 5/1991 | Brighton | 102/430 |

FOREIGN PATENT DOCUMENTS

| | | | |
|---|---|---|---|
| 357445 | 7/1980 | Austria . | |
| 552879 | 5/1923 | France . | |
| 2388242 | 12/1978 | France . | |
| 1016163 | 9/1957 | Germany . | |
| 1138341 | 10/1962 | Germany . | |
| 2822624 | 12/1978 | Germany | 102/444 |

*Primary Examiner*—Harold J. Tudor
*Attorney, Agent, or Firm*—David J. French

[57] ABSTRACT

A cartridge 10 for low-mass, frangible projectiles 60 comprises a cartridge case 12 having a primer 14 at its base and a sabot 30 or piston 30 at its mouth. The piston 30 can be provided with longitudinal orifices 44, diagonal orifices, 44*a*, grooves 64 or any combination of orifices and grooves. The projectile 60 is inserted into a cylindrical recess 46 in the front portion of the sabot 30. The orifices 44 are in communication with this recess 46 to permit propellant gas to bleed through and accelerate the projectile 60 upon ignitión. The case 12 and the sabot 30 can be provided respectively with a crimp 24 and a stepped portion 48 in order to limit travel of the sabot 30 out of the case.

13 Claims, 4 Drawing Sheets

REDUCED ENERGY CARTRIDGE

This is a continuation-in-part of my application Ser. No. 497,027 filed 22 Mar., 1990, now abandoned.

BACKGROUND OF THE INVENTION

In general, the present invention relates to the field of ordinance and, more specifically, to non-lethal ammunition used in training and war games.

FIELD OF THE INVENTION

Normal automatic and semi-automatic weapons are actuated conventionally either by the expansion of propellant gas against a piston connected to the recoiling bolt mass or by direct blowback of the cartridge case against the bolt upon expansion of the propellant gas during the ballistic cycle of the ammunition. In these systems, the energy provided to the recoil mechanism is somewhat dependant on that imparted to the projectile. That is, a reduced pressure in the chamber or variations in weight of the projectile will result in variation in the total energy given to the weapon-operating mechanism which, in turn, will affect its cyclic rate or the reliability of its operation. With low-mass projectiles or the type used in training and non-lethal ammunition, the problem is especially severe. Frangible projectiles may not be capable of withstanding high accelerations. The low energy required for launch of these lightweight projectiles may not produce a sufficient reaction or necessitate a high enough chamber pressure to cycle conventional weapon mechanisms. Blank ammunition, that is, a cartridge without a projectile, will not normally be able to cycle a weapon without a muzzle adapter to increase the pressure in the system sufficiently to make the mechanism function.

The problem may also be observed in larger caliber guns, such as 40 mm grenade launchers, where a relatively low-velocity projectile with limited capacity to withstand high accelerations, is launched from an automatic gas-operated weapon. Prior attempts to achieve reliable weapon function, along with low-peak projectile acceleration have included "high-low" ballistic systems wherein propellant is initially burned in a high-pressure section of a partitioned cartridge case and released through orifices into the side containing the projectile at a rate sufficient to limit the peak pressure or acceleration on the projectile. Such a system is described in U.S. Pat. No. 4,686,905 (Szabo). While such systems can provide reduced peak forces available for weapon function, necessitating design compromises in the weapon.

SUMMARY OF THE INVENTION

The primary object of this invention is to provide an ammunition configuration which will provide a more constant impulse to a weapon-cycling mechanism to assure its reliable function independent of the energy imparted to the projectile or even whether a projectile is present. This will permit the launching of low mass or acceleration-sensitive projectiles without exceeding their limitations or the firing of a blank cartridge while still providing reliable cycling of the weapon.

It is a further object of this invention to provide these functions in a conventional blowback-type of weapon with a minimum of changes to the weapon itself, permitting it to fire at reduced velocity, frangible or non-lethal or blank ammunition while still functioning in a normal manner.

It is a still further object of this invention to provide a means for cycling a weapon which uses an ammunition design compatible with existing manufacturing processes to minimize cost and make maximum use of existing production facilities.

These and other objects of the invention are achieved by the provision of a cartridge for low-mass, frangible projectiles which comprises a cartridge case having a primer at its base and a sabot or piston at its mouth.

The sabot acts as a "shoe" or holder for the projectile. It is also present in the case of a blank variant of the invention wherein, as in the projectile version, it serves as a plug and piston in the end of the cartridge casing. While the description that follows refers to this component as a "sabot" in order to demonstrate the invention, in its broader characterization, this component of the cartridge of the invention may be called a "piston"—and will be claimed as such. The sabot terminates with an outer annular shoulder that can thrust against a complementary, inwardly-formed step or inclined shoulder formed at the end of the chamber of a fire arm around the entrance to the barrel. The sabot is slideably contained within the cartridge case with a sealed engagement which permits little gas flow therebetween. The sabot can be provided with the longitudinal orifices, diagonal orifices, flutes, or any combination of orifices and flutes to provide a path for propellant gas from the volume of the case behind the sabot to flow to the rear of the projectile, and thence to the barrel of the gun. The projectile is inserted into a cylindrical recess in the front portion of the sabot. The orifices are in communication with this recess to permit propellant gas to bleed through and accelerate the projectile upon ignition. The amount of energy imparted to the projectile can be adjusted by varying the size of the orifices.

Upon ignition of the primer the cartridge casing, and/or the amount of propellant associated with the primer which is free to be displaced rearwardly, is so displaced under pressure from the exploding propellant. By reason of such rearward displacement, momentum is imparted to the breech block sufficient to cycle the weapon. The case and the sabot can be provided respectively with a crimp and a stepped portion in order to limit travel of the cartridge case with respect to the sabot.

A better understanding of the disclosed embodiments of the invention will be achieved when the accompanying Detailed Description is considered in conjunction with the appended drawings, in which like reference numerals are used for the same parts as illustrated in the different figures.

DETAILED DESCRIPTION OF THE PREFERRED EMBODIMENTS

Figure 1:
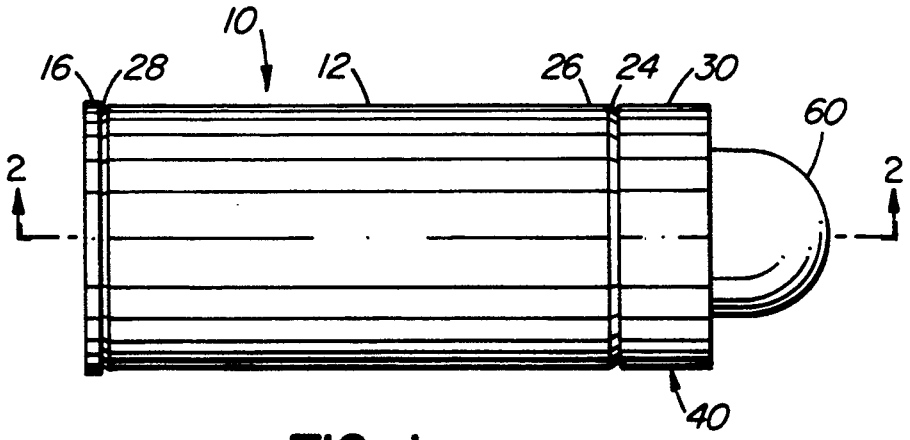
FIG. 1 is a side elevational view of a cartridge in accordance with a first embodiment of the invention.

In describing the preferred embodiments of the subject invention illustrated in the drawings, specific terminology will be resorted to for the sake of clarity. However, the invention is not intended to be limited to the specific terms so selected, and it is to be understood that each specific terms includes all technical equivalents which operate in a similar manner to accomplish a similar purpose.

Figure 2:
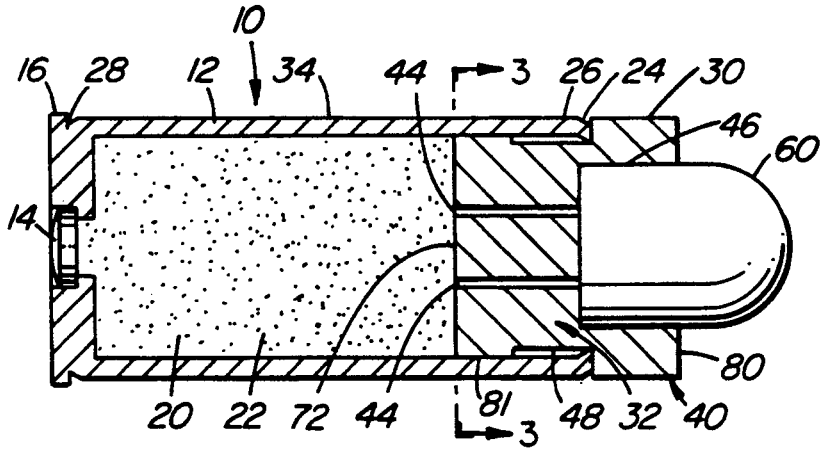
FIG. 2 is a cross-sectional view of the cartridge of FIG. 1, taken along line 2—2 of FIG. 1.
Figure 3:
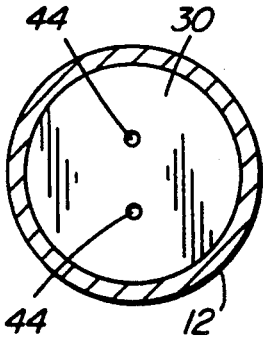
FIG. 3 is a cross-sectional view of the cartridge of FIG. 1, taken along line 3—3 of FIG. 2.

A first embodiment of a cartridge in accordance with the present invention is depicted generally in FIGS. 1 through 3. The cartridge 10 comprises a cartridge case 12 containing a primer 14 in the base or head 16 of the case 12 to provide ignition and/or propulsion energy. A conventional propellant 20 may optionally be located within the case cavity 22 to provide the required propulsion energy if the energy of the primer 14 is insufficient to sufficiently excite the weapon and propel the projectile (if included). A flange 24 or crimp 24 can be provided at the mouth or front end 26 of the case for a purpose to be described hereinafter. An extraction groove 28 is conventionally provided adjacent base 16 for use in the ejection process. Alternatively, a conventional flange (not shown) can be provided.

A one-piece piston or sabot 30 having forward 80 and rearward 72 ends, is inserted in the mouth 26 of cartridge case 12. The outer diameter of at least a portion of the rear portion 32 of sabot 30 is substantially equal to the inner diameter of wall 34 of case 12 to fit snugly and sealingly against the inner surface of wall 34 of case 12, restraining the escape of the propellant gas. The rear portion 32 can be formed with one or more additional portions having sidewalls 81 of decreased diameter, i.e., a diameter less than the inner diameter of wall 34, for the purpose to be described hereinafter. The forward portion 40 of the sabot 30 is larger in diameter than the rear portion 32, being substantially equal to the outer diameter of wall 34, to fit snugly in the chamber 102 of the gun with such forward portion 40 in contact with the annular step 100 forming the end of the chamber 102. This step 100 defines the entrance of the inner bore in the barrel of the firearm (see FIG. 14).

Longitudinal orifices 44 extend through the rear portion 32 of the sabot 30, opening into and terminating at a cylindrical axial recess 46 formed in the sabot 30 at the forward end 80 of the rear portion 32, to provide a path or gas passage means 44 for propellant gas from the larger area of cavity 22 within the case 12 to the forward end 80 of the sabot 30, rearwardly of the projectile 60, and thence to the barrel of the gun. As shown in FIGS. 2 and 3, there are two orifices 44 equidistant from the longitudinal axis of sabot 30 and parallel with the longitudinal axis and each other. However, the precise positioning and number of orifices 44 is not considered to be critical. For example, although two orifices may be provided for balance, it is possible to use a single orifice, located axially or elsewhere.

An inward step 48 defined by the transition between the portions of differing diameter can be formed in the sidewall 81 of the rear portion 32 of sabot 30 rearwardly of and spaced-apart from the front portion 40, for a purpose to be described hereinafter. The projectile 60 is contained in recess 46 in the front portion of sabot 30. In the case of a blank, as will be described in greater detail hereinafter with respect to FIGS. 13 and 14, the projectile is omitted, permitting the gas to escape directly down the barrel.

Upon initiation of the primer 14 by the weapon firing pin (not shown), gas is generated by the primer 14 and/or the propellant 20 it ignites. The front portion 40 of the sabot 30 is restrained from moving forward by the step 100 in the chamber 102 of the weapon (see FIG. 14) that is complementary to and engages with the outer annular shoulder 76 formed around the forward end 40 of the sabot 30. Though shown as being perpendicular to the direction of the barrel, the step 100 and shoulder 76 may be obliquely oriented so long as the shoulder 76 may thrust against the step 100. The expanding gas therefore propels the case 12 rearward, imparting momentum to the bolt of the weapon. Concurrently, the gas can flow through the orifices 44 to the projectile 60, beginning its acceleration. The amount of energy imparted to the projectile 60 can be adjusted by varying the size of the orifices 44. In the case of a blank, at this time, the gas is permitted to escape down the barrel causing the flash and noise that simulates the firing of an actual bullet.

The travel of the sabot 30 can be limited by an inwardly displaced flange 24, which may be in the form of a crimp, at the case mouth 26 which interferes with the side of the inwardly formed step 48 in the sidewall 81 of sabot 30 when it reaches the end of its travel. It can also be limited by the sidewall friction combined with decreasing internal pressure, eliminating the need for the step 48 in the sabot 30.

As the projectile 60 accelerates down the barrel, the case 12 and sabot 30 continue to be extracted by the bolt, rearward as a unit, to be ejected in the same manner as a conventional cartridge case is ejected from a recoiling bolt weapon. Because the case 12 is set in motion by the firing, there is reduced chance that it will seize within the chamber 102. This, in turn, allows a lighter gauge of material to be used for the wall 34 of the casing 12.

Figure 4:
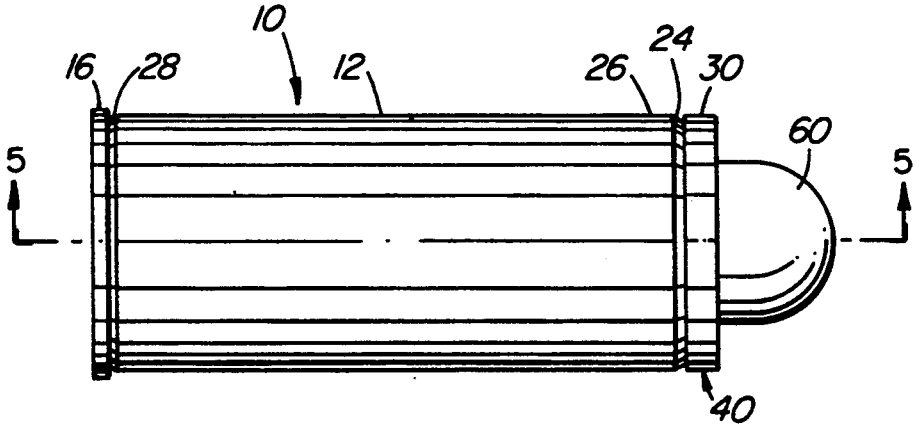
FIG. 4 is a side elevational view of a cartridge in accordance with a second embodiment of the invention.
Figure 5:
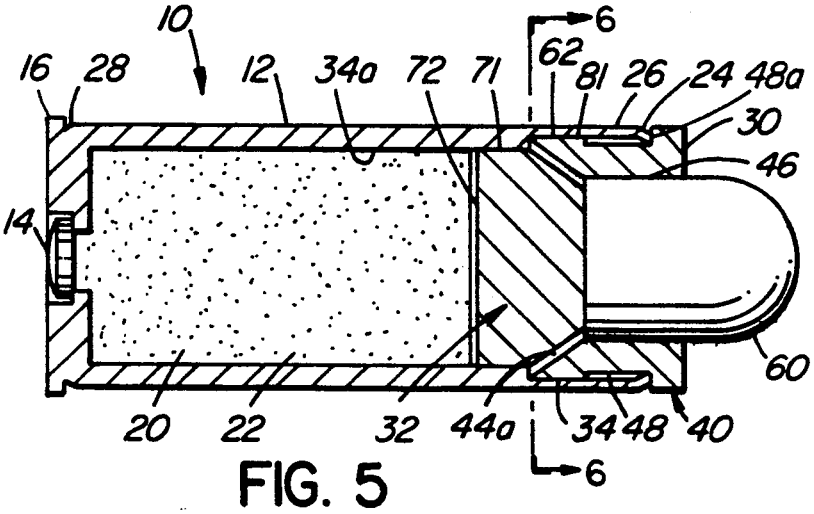
FIG. 5 is a cross-sectional view of the cartridge of FIG. 4, taken along line 5—5 of FIG. 4.
Figure 6:
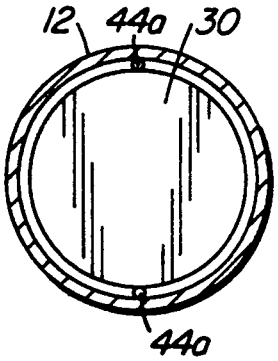
FIG. 6 is a cross-sectional view of the cartridge of FIG. 4, taken along line 6—6 of FIG. 5.
Figure 7:
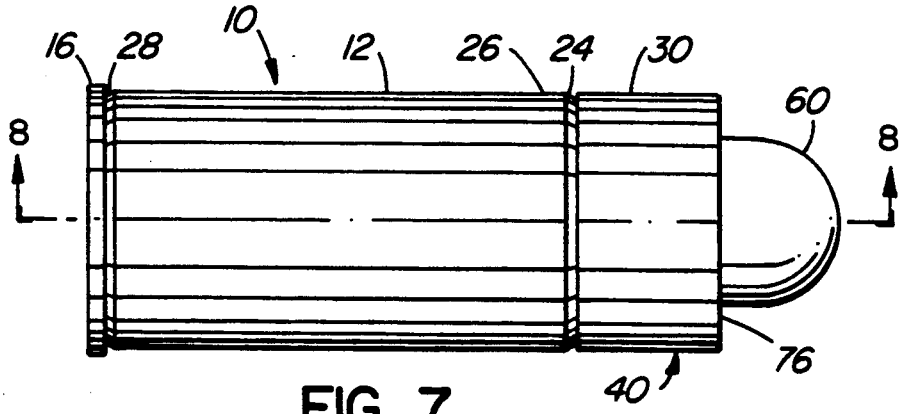
FIG. 7 is a side elevational view of a cartridge in accordance with a third embodiment of the invention.
Figure 8:
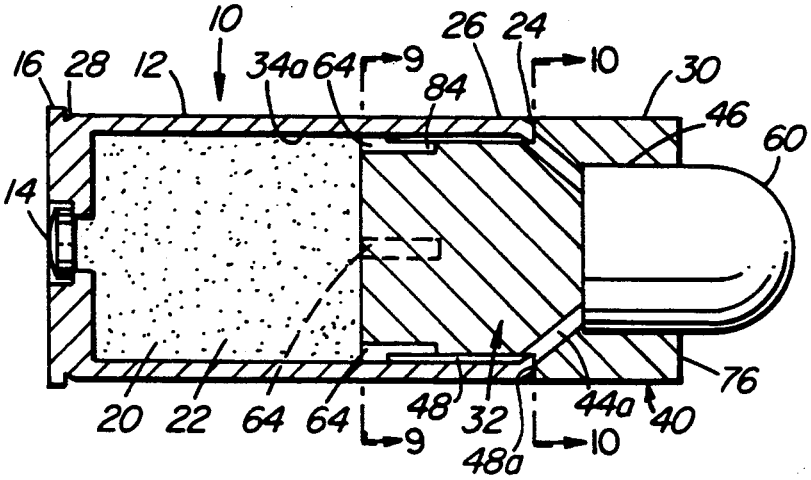
FIG. 8 is a cross-sectional view of the cartridge of FIG. 7, taken along line 8—8 of FIG. 7.
Figure 9:
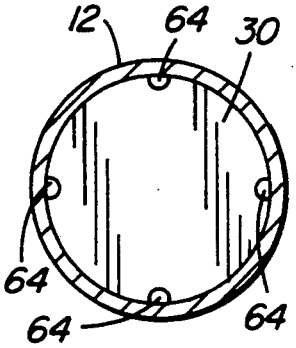
FIG. 9 is a cross-sectional view of the cartridge of FIG. 7, taken along line 9—9 of FIG. 8.
Figure 10:
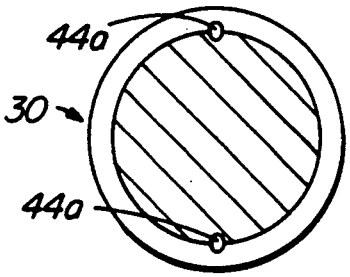
FIG. 10 is a cross-sectional view of the cartridge of FIG. 7, taken along line 10—10 of FIG. 8.

A second embodiment of the invention is shown in FIGS. 4 through 6. In this configuration, the sabot 30 is reduced in diameter at the rear portion 32 by providing an inwardly stepped surface 71 to fit snugly into a case 12 having a thinner, stepped portion 62 defined by a thicker sidewall 34*a* set inwardly from the mouth 26. Also, diagonal orifices 44*a*, which serve partial as gas passage means 44*a*, are provided in the rear portion 32 of sabot 30. Orifices 44*a* angle outwardly and rearwardly from the forward end 80 of the sabot 30 (being in the case where a projectile is present, the bottom of the recess 46) towards the rear portion 32 of sabot 30, terminating at the inwardly stepped surface 71 where the sabot 30 is of reduced diameter at a location short of the rearward end 83 of the sabot 30. Upon initialization of the primer 14 and/or propellant 20, the gas is completely trapped until the end of the thinner stepped portion 62 in the case wall 34*a* clears the rear end 72 of the sabot 30, permitting the gas to flow through the orifices 44*a* to the projectile 60 and assuring that the weapon receives sufficient operating impulse prior to projectile acceleration.

A third embodiment of the invention in shown in FIGS. 7 through 10. The rear portion 32 of the sabot is fluted by grooves 64 (four being shown but one being sufficient) to permit the escape of gas when the case has moved rearward sufficiently to uncover the terminal end 84 of one of the grooves 64. At that time, gas flows through the grooves 64 along the step 48 to the forward end wall 48*a* of the step 48 and through the angled sabot orifices 44*a* to the base of the projectile 60 causing its acceleration as described above. This design also prevents the propellant gas from reaching the orifices 44*a* and thence the projectile 60 until the movement of the sabot 30 has almost reached its limit, assuring that sufficient energy has been supplied to the bolt to cycle the weapon regardless of the energy supplied to the projectile 60. Further, it eliminates the need for the step 62 in the cartridge case 12 as shown in FIG. 5.

Figure 11:
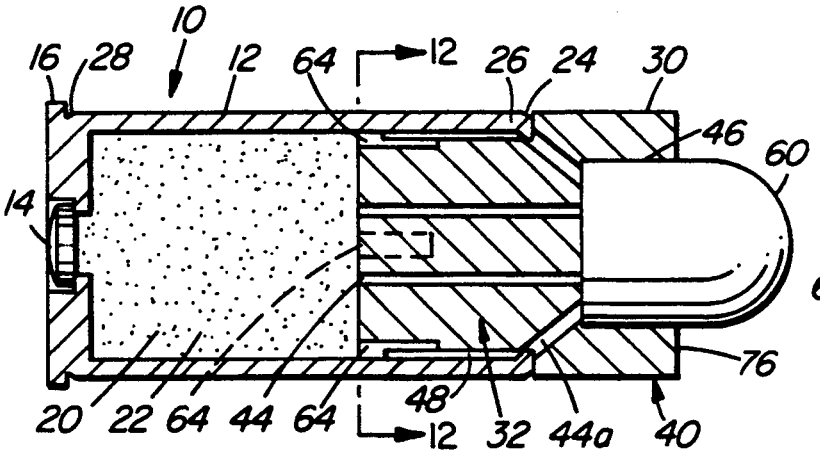
FIG. 11 is a cross-sectional view of a cartridge in accordance with a fourth embodiment of the invention.
Figure 12:
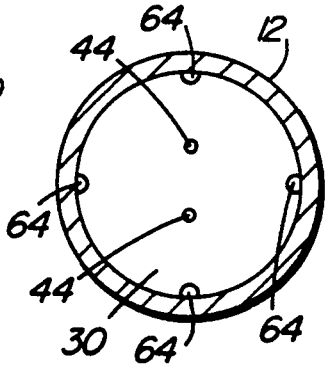
FIG. 12 is a cross-sectional view of the cartridge of FIG. 11, taken along line 12—12 of FIG. 11.

A fourth embodiment of the invention is shown in FIGS. 11 and 12. It is similar to the third embodiment shown in FIGS. 7 through 10, except that it also contains longitudinal orifices 44 extending through the sabot 30, as in the first embodiment as shown in FIG. 2, to permit propellant gas to bleed through and accelerate the projectile 60 immediately upon ignition. Orifices 44 are designed to provide sufficient but limited pressure in the barrel before the case 12 and the bolt have moved rearward sufficiently to uncover the grooves 64 in the sabot 30. During this period the projectile 60 is accelerated to the end of the gun barrel. When the grooves 64 are uncovered, a much greater volume of gas is released, causing more noise and flash than can be obtained with either of the embodiments shown in FIG. 1 or FIG. 3. By proper design of the longitudinal orifices 44, the diagonal orifices 44*a*, bolt mass and propellant parameters, it is possible to obtain equivalent noise and recoil to a conventional weapon firing ball ammunition, while firing a reduced-energy projectile.

The same concept, that is, the use of an orifice tailored to open at some point in the travel of the projectile in the barrel, in combination with an orifice to provide initial projectile acceleration, can also be used to provide a boost in acceleration to larger mass projectiles in conventional weapons, increasing their velocities without exceeding the maximum pressure limitations of the weapon and barrel.

Figure 13:
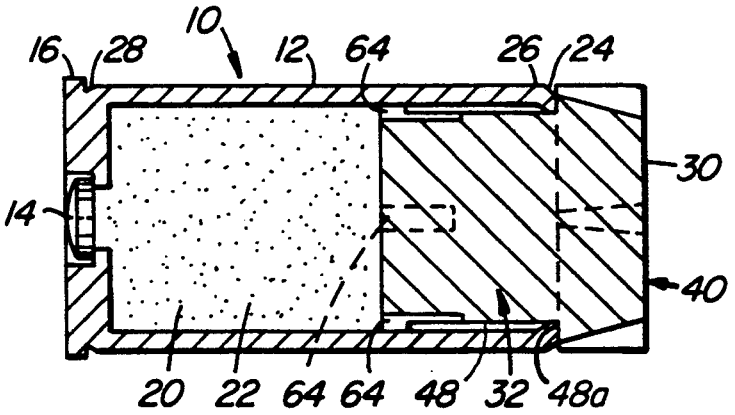
FIG. 13 is a cross-sectional view of a cartridge in accordance with a fifth embodiment of the invention.
Figure 14:
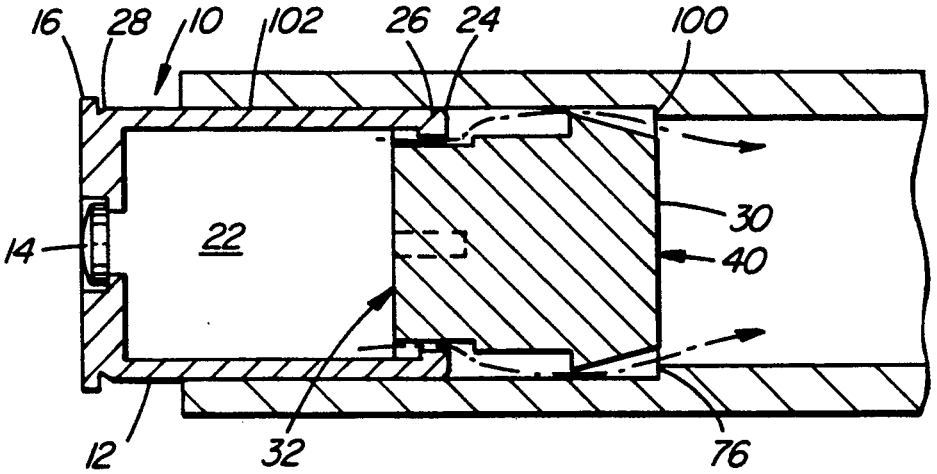
FIG. 14 is a cross-sectional view of the cartridge of FIG. 13, in the fired position.

FIGS. 13 and 14 show a fifth embodiment of the invention, a blank cartridge operating on the same principle as the first embodiment shown in FIGS. 1 through 3. The propellant energy is used to accelerate the weapon mechanism and the residual gas energy is released down the barrel when the grooves 64 in the rear portion 32 of sabot 30 are uncovered by the movement of the case 12 with respect to the sabot 30. This provides a means for cycling some weapons without the need of a blank firing adapter.

Figure 15:
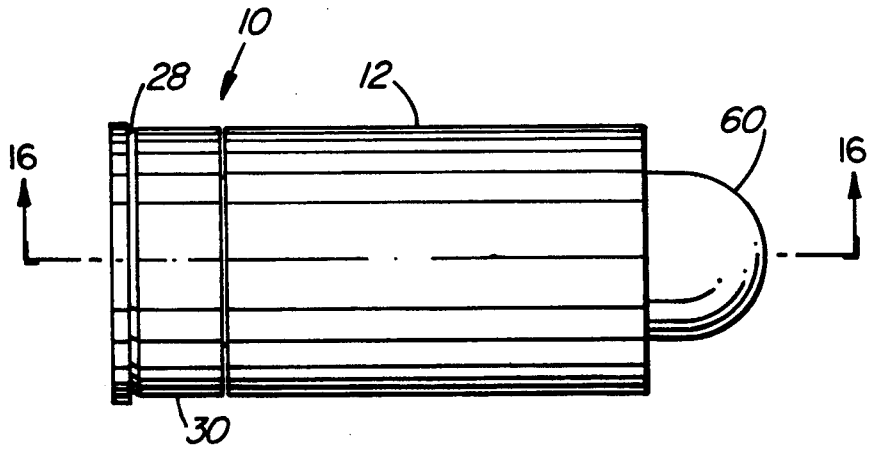
FIG. 15 is a side elevational view of a cartridge in accordance with a sixth embodiment of the invention.
Figure 16:
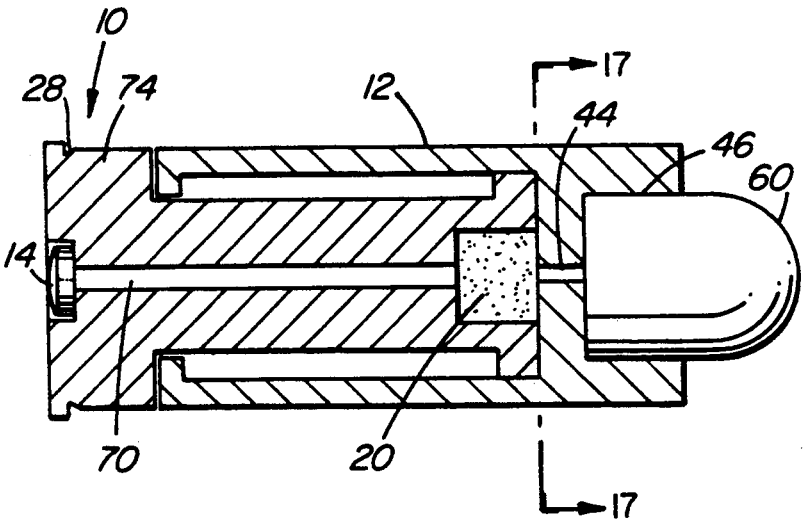
FIG. 16 is a cross-sectional view of the cartridge of FIG. 15, taken along line 16—16 of FIG. 15.
Figure 17:
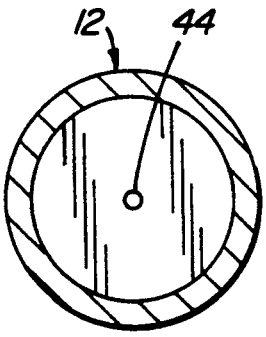
FIG. 17 is a cross-sectional view of the cartridge of FIG. 15, taken along line 17—17 of FIG. 16.

Another variation of the embodiment shown in FIGS. 1 through 3 is shown in FIGS. 15 through 17. In this sixth embodiment, the the case 12 is reduced in size in proportion to the sabot 30 are reversed. In some weapons this configuration provides more support to the stationary component, permitting the gas to expand the case 12 against the wall of a tapered chamber of the weapon to provide additional bearing surface during the ballistic cycle. This can permit the use of a thinner wall case but carries with it the risk that the cartridge 10 may be more resistant to ejection. Nevertheless, so long as a significant proportion of the case wall 12 blows-back against the bolt on firing, then the benefits of the invention will be present. In this embodiment, the primer 14 and the propellant 20 are both positioned in a piston 74, and are in communication through a flash hole 70. Likewise, a single longitudinal orifice 44 and the recess 46 are formed in case 12.

All of the above embodiments can be used in conventional blowback weapons, such as small pistols and submachine guns, with little or no modification of the weapons. Their use in larger pistols which use a form of delayed blowback cycling mechanism and their use in semiautomatic gas-operated weapons, such as most rifles and automatic cannon, require changes to the weapon to convert them to a blowback-operated mechanism.

From the above, it is apparent that any modifications and variations of the present invention are possible in light of the above teachings. It is therefore to be understood that, within the scope of the appended claims, the invention may be practices otherwise than as specifically described.

I claim:

1. A cartridge 10 for insertion into a firearm having a barrel with an inner bore and a firearm chamber 102, the firearm chamber 102 having an annular step 100 at its forward end, the inner diameter of such step bounding the inner bore of the barrel of the firearm, comprising (1) a cartridge case having a base end 16 and front end 26 and an inner diameter at said front end 26;

(2) a source 14 for propellant gas within the cartridge 10;

(3) a piston 30 having a substantially closed rearward end, wherein said rearward end is sealingly positioned within said cartridge case 12 at a location spaced from the base end 16 of the cartridge case 12 and defining a closed cavity 22 within the cartridge case 12, said cavity 22 containing the source for propellant gas, the piston 30 having a front piston end 40 bounded by an outer, annular shoulder 76 defining the forwardmost portion of the piston 30, said front piston end 40 extending forward of the front end 26 of the case 12, said annular shoulder 76 having a diameter that is larger than the inner diameter of the case 12 at its front end 26 and larger than the inner diameter of the step 100 at the forward end of the firearm chamber 102; and (4) gas passage means, extending from said closed cavity 22 through said piston 30, to permit gas generated within the cavity 22 subsequent to firing of the cartridge 10 to pass outwardly from the front piston end 40 of the piston, at least a portion of said cartridge case 12 being slidable on said piston 30, and means for limiting sliding displacement in the rearward direction of the case 12 with respect to said piston 30 upon firing of the cartridge 10.

2. A cartridge 10 as in claim 1 wherein the means for limiting sliding displacement is provided by:

(1) the piston 30 being provided with a sidewall 81 with an inwardly formed step 48 within the rear portion 32 of the piston 30, such step extending to a point that is short of the rearward end 72 of the piston 30; and (2) the case 12 having a wall 32 which is provided with an inwardly displaced flange 24 to engage with the inwardly formed step 48, whereby the case 12 is slidingly displaceable on the piston 30 along the length of the inwardly formed step 48 without disengaging therefrom.

3. A cartridge as in claim 1 or 2 wherein before firing said piston 30 and case 12 are in contact with each other whereby said gas passage means is initially occluded, said gas passage means becoming opened upon displacement of the cartridge case 12 rearwardly with respect to the piston 30.

4. A cartridge as in claim 1 wherein:

(a) the piston 30 is provided within its sidewall 81 with an inwardly formed step 48 having a forward end **48*a* within the rear portion 32 of the piston 30**;

(b) the sidewall 81 of the piston 30 is provided with at least one groove 64 in its rear portion 32 that extends from the rearward end 72 of the piston 30 to a terminal end 84 for the at least one groove 64 at a position intermediate the rearward end 72 of the piston 30 and the forward end **48*a* of the inwardly formed step said at least one groove 64 being connected to said step 48**;

(c) partial gas passage means **44*a* extends from the forward end of the piston 30 to the step 48 to provide a passageway to the inwardly formed step 48, whereby upon rearward displacement of the cartridge case 12 with respect to the piston 30, propellant gas flows from the closed cavity 12 out through the forward end 80 of the piston 30 through the at least one groove 64, the step 48 and the partial gas passage means 44*a***.

5. A cartridge as in claims 1 or 2 wherein:

(1) the piston 30 is provided within its sidewall 81 with an inwardly formed stepped surface 71 within the rearward portion 32 of the piston 30, such stepped surface 71 extending to the rearward end 72 of the piston;

(2) the wall 34 of the case 12 is provided with a thicker sidewall **34*a* overlying and sealingly engaging with a sliding fit with the stepped surface 71**;

(3) the wall 34 of the case 12 is provided with thinner portion 62 to engage with the sidewall of the piston 30 forward of the stepped surface 71; and (4) indirect gas passage means **44*a* extends from the forward end of the piston 30 to provide a passageway to the inwardly formed stepped surface 71 short of the rearward end 72 of the piston 30, whereby upon firing and rearward displacement of the cartridge case 12 with respect to the piston 30, propellant gas flows from the closed cavity 12 out through the forward end 80 of the piston 30**.

6. A cartridge as in claims 1 or 2, wherein said gas passage means comprises both indirect gas passage means **44*a* which are initially occluded and a supplementary direct gas passage 44 extending through the piston 30 from the cavity 12 to the forward end of the piston 30 whereby propellant gas will pass directly through said direct gas passage 44 during the period that indirect gas passage means 44*a*** are occluded.

7. A cartridge as in claim 6 wherein the direct passage 44 is dimensioned to allow the propellant gas to carry a projectile 60 beyond the muzzle of the barrel in the time taken for the indirect gas passage means **44*a*** to become opened.

8. A cartridge as in claim 6 wherein the direct passage 44 is dimensioned to allow the propellant gas to carry a projectile 60 part way along the barrel towards the muzzle of the barrel in the time taken for the indirect gas passage means **44*a*** to become opened.

9. A cartridge as in claims 1, 2 or 4 having a primer wherein said primer constitutes the supply of propellant gas.

10. A cartridge as in claim 9, including an additional propellant gas material in said cavity.

11. A cartridge as in claims 1, 2 or 4 including a projectile in the forward end of said piston.

12. A cartridge as in claim 2 wherein the inwardly formed step 48 has a forward end **48*a*** and comprising:

(a) at least one groove 64 formed in the sidewall 81 of the piston 30 in its rear portion 32, said at least one groove 64 extending from the rearward end 72 of the piston 30 to a terminal end 84 for the at least one groove 64 at a position intermediate the rearward end 72 of the piston 30 and the end **48*a* of the inwardly formed step 48, said at least one groove being connected to said step 48; and (b) partial gas passage means 44*a* extending from the forward end of the piston 30 to the step 48 to provide a passageway to the inwardly formed step 48, whereby upon rearward displacement of the cartridge case 12 with respect to the piston 30, propellant gas flows from the closed cavity 12 out through the forward end 80 of the piston 30**.

13. A cartridge 10 as in claims 1, 2 or 4 wherein said case 12 has an outer diameter at its front end 40 and the diameter of the annular shoulder 76 is substantially equal to said outer diameter of the case 12 at its front end.

* * * * *